US006500098B1

(12) United States Patent
Werner

(10) Patent No.: US 6,500,098 B1
(45) Date of Patent: Dec. 31, 2002

(54) BICYCLE TRAINING APPARATUS

(76) Inventor: Todd R. Werner, 75 Fortier Dr., Williston, VT (US) 05495

( * ) Notice: Subject to any disclaimer, the term of this patent is extended or adjusted under 35 U.S.C. 154(b) by 0 days.

(21) Appl. No.: 09/557,588

(22) Filed: Apr. 22, 2000

(51) Int. Cl.[7] ..... A63B 21/00
(52) U.S. Cl. ..... 482/57; 482/61
(58) Field of Search ..... 482/57–63

(56) References Cited

U.S. PATENT DOCUMENTS

| | | | | |
|---|---|---|---|---|
| 463,862 | A | * 11/1891 | Guignard | |
| 581,835 | A | * 5/1897 | Sturgis | |
| 2,534,967 | A | * 12/1950 | Hapman | 272/73 |
| 3,572,758 | A | * 3/1971 | Lee | 280/296 |
| 5,662,559 | A | * 9/1997 | Vasquez | 482/61 |
| 5,916,068 | A | * 6/1999 | Chisholm et al. | 482/61 |

* cited by examiner

*Primary Examiner*—Stephen R. Crow

(57) ABSTRACT

A bicycle roller training system of the type having three rollers for supporting a freestanding bicycle uses rollers of a novel design. The rollers comprise a cylindrical middle portion of a uniform first diameter, two end portions of a second diameter larger than the first diameter, and two transitional portions between the middle portion and the end portions. The length of the middle portion is greater than the tread width of a tire of a bicycle with which the apparatus is used. The transitional portions increase in diameter from the cylindrical middle portion toward the ends of the roller. The transitional portions preferably have a curvilinear profile, and the preferred profile of the transitional portions is a parabolic curve. Thus the transitional portions preferably comprise paraboloids of revolution. The rollers also have disk-shaped weights mounted at one or more ends for increased angular momentum. Axles of the rollers are rotatably mounted to a frame. One or more steps may be provided on the frame for convenience in mounting the bicycle.

33 Claims, 7 Drawing Sheets

BICYCLE TRAINING APPARATUS

TECHNICAL FIELD

The present invention relates to the field of bicycle training apparatus; more specifically, it relates to roller system bicycle trainers.

BACKGROUND ART

A conventional bicycle roller system is a training device for bicyclists typically consisting of three parallel cylindrical rollers supported horizontally in a frame. One roller is positioned below the front wheel of the bicycle and two are positioned below the driven rear wheel. The two rear rollers are placed such that the rear wheel is cradled between them and in contact with both rear rollers at once. The front roller is linked to one of the rear rollers so that when a bicycle is ridden upon the system, both wheels of the bicycle spin at the same speed and impart stability to the bicycle via gyroscopic inertia. Such a bicycle roller system is described in U. S. Pat. No. 581,835 to Sturgis. This inertia allows the bicycle to be maintained in an upright position, but does little to limit lateral movement on the roller system. Minimal deviation of the front wheel from a straight-ahead orientation or a slight shift of the bicycle rider's weight, causes relatively large lateral movement of the bicycle as compared to a bicycle on the ground. This potential for lateral movement and its sensitivity to rider input make rollers an excellent training device to improve bicycle handling skills, but severely limit their use for cardiovascular fitness. The average rider is constantly at risk of riding off the side of the rollers, as is an accomplished bicyclist should he become fatigued and lose concentration while riding. One solution to the problem of riding off the sides of the rollers is described in U.S. Pat. No. 463,862 to Guignard which employs concave rollers. Concave rollers in which the concavity is minimal (i.e., rollers having a shallow curvature) offer little aid in keeping the bicycle centered upon the roller. Concave rollers in which the concavity is severe (i.e., rollers having a deep curvature) reduce the skill-training benefit of rollers, while giving the sensation of riding down into a groove in the ground.

In addition, the uniform diameter rollers used by most conventional systems, carry little angular momentum. Thus, when the rider stops pedaling, the wheels stop in a matter of seconds and all gyroscopic-inertia helping to balance the bicycle is lost. This makes dismounting without falling difficult. A solution to the de-mounting problem is described in U.S. Pat. No. 3,905,597 to Tabb, which describes elevated and inwardly slanted platforms located adjacent to the pedaling region and positioned to be readily reached by the feet of the bicycle operator when the bicycle is in an upright operating position. However, the presence of such platforms can in itself present additional safety and convenience problems.

Because of the above difficulties, bicycle roller use is usually limited to skill training by accomplished riders.

DISCLOSURE OF INVENTION

This patent describes a bicycle roller system of the three-roller type, using rollers of a novel design. Each of the rollers comprises a "flat" (right-cylindrical) middle portion or central span of a first diameter, two end portions of a second diameter larger than the first diameter and two transitional portions, which are between the middle portion and each of the end portions. The transitional portions increase in diameter from the middle portion toward the ends of the roller. The transitional portions preferably have a curvilinear profile and an identical profile at both ends of a roller. The most preferred rate of increase of diameter of the transitional portions is a parabolic rate; i.e., the diameter is a parabolic function of distance measured along a direction parallel to the roller axis. Another equivalent way of characterizing the preferred shape of the transitional portion is to define it as paraboloidal. The rollers also preferably have disks of a relatively high density mounted at one or more ends as disk-shaped weights. The middle portion or central span of each roller, being of uniform diameter, allows skill training and as realistic a feel as on a system employing conventional flat rollers. The parabolic rate of increase in the diameter of the transitional portions of the rollers yields multiple benefits. First, the transitional portions impart a centralizing force to the bicycle tires when the tires leave the central span. This centralizing force increases the closer the tires come to the end of the roller, making it difficult to ride off the rollers. At a given rotational speed, the roller having a disk-shaped weight affixed at the end of the roller has greater angular momentum than a standard unweighted roller of lesser diameter, without requiring the entire roller to be of large diameter and without requiring massive weight to be used in small diameter rollers. The increased angular momentum or flywheel effect allows a rider to coast on the rollers, simulating actual ground riding. The flywheel effect also allows a rider time to start dismounting, i.e., to disengage his foot from a bicycle pedal and place the foot upon the supporting surface mounted under the bicycle, before the gyroscopic-inertia from the spinning wheels, which helps balance the bicycle, is lost. The rate of increasing diameter of the three rollers transitional portions can vary, even within a single system, as can the widths of the rollers and the widths of the "flat" middle portions. Specifically, if the transitional portions' diameters vary in the preferred parabolic manner, the parabolic rates of increase of the diameter of the transitional portions can vary

BRIEF DESCRIPTION OF DRAWINGS

The novel features believed characteristic of the invention are set forth in the appended claims. The invention itself, however, as well as a preferred mode of use and objects and advantages thereof, will best be understood by reference to the following detailed description of an illustrative embodiment when read in conjunction with the accompanying drawings, wherein:

MODES FOR CARRYING OUT THE INVENTION

Figure 1:
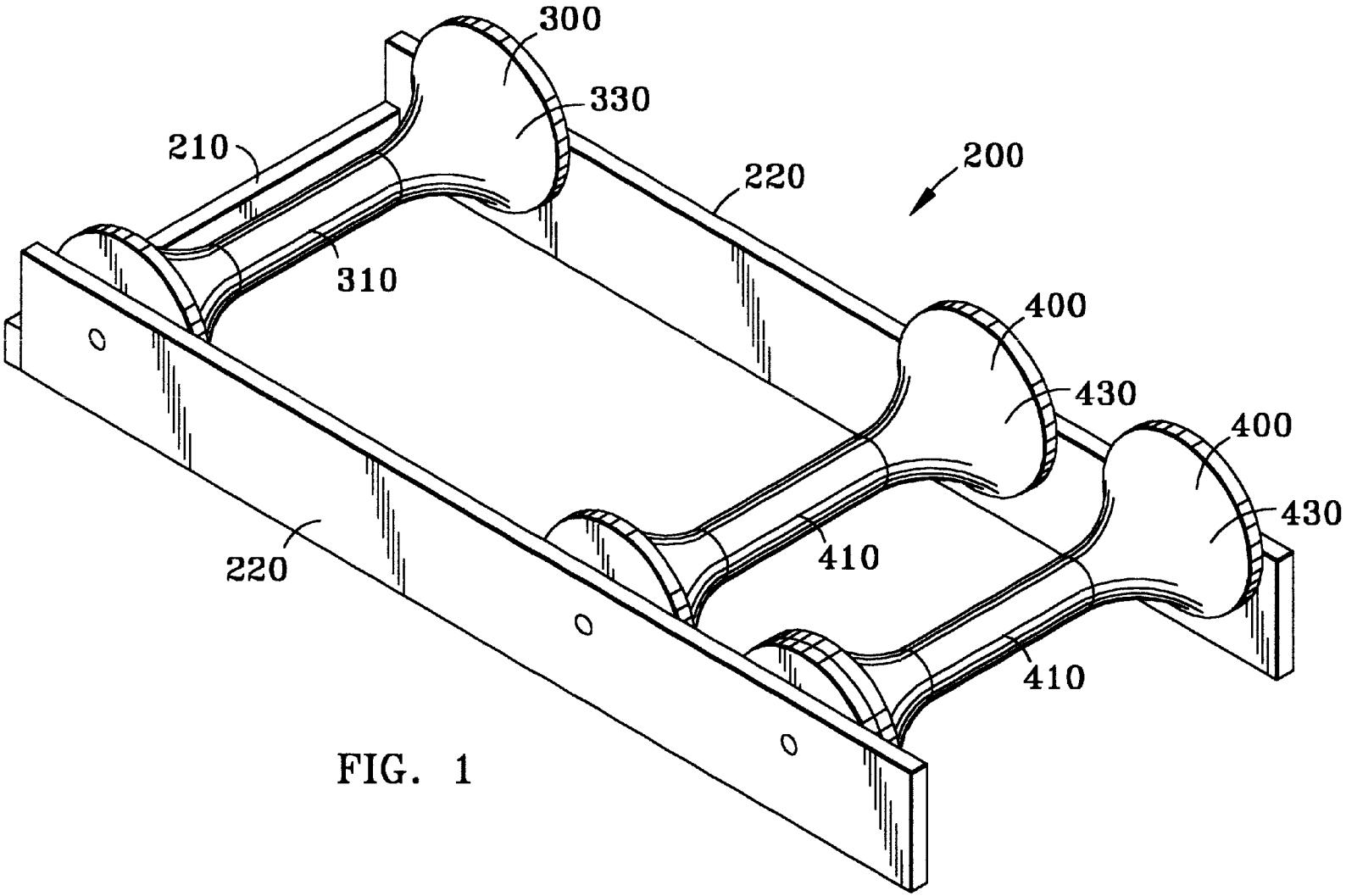
FIG. 1 is a perspective view of a bicycle trainer made in accordance with the present invention.
Figure 2:
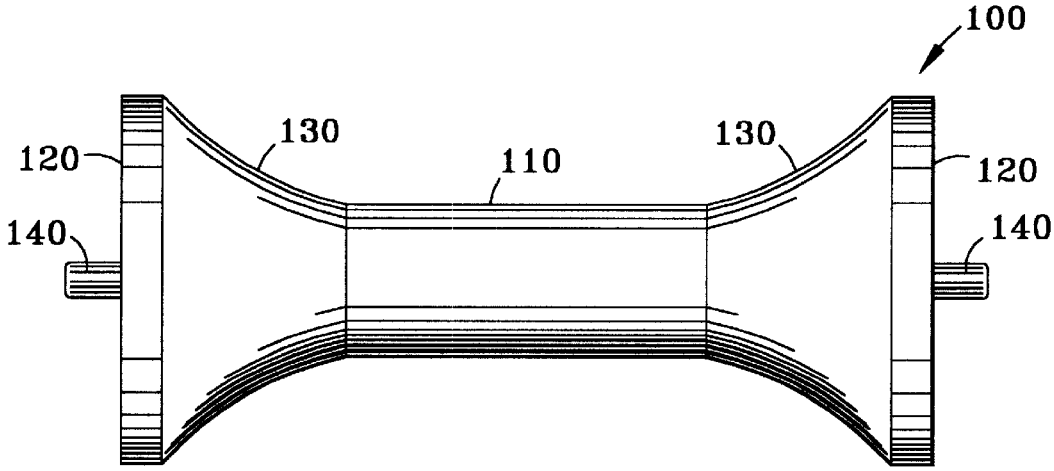
FIG. 2 is a front elevation view of a roller of the bicycle trainer of the present invention.
Figure 12:
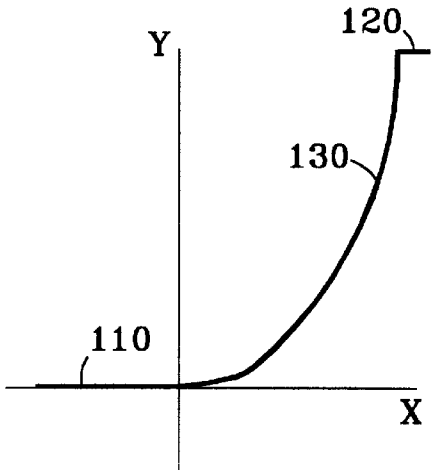
FIG. 12 is a graph illustrating a geometric relationship of the present invention.

FIG. 1 shows a perspective view of a bicycle trainer made in accordance with the present invention. FIG. 2 shows a front view of a roller of the bicycle trainer of FIG. 1. Roller 100 comprises a "flat" middle portion 110 of a first diameter, uniform along the length of the middle portion 110, two ends 120 of a second diameter larger than the first, and two transitional portions 130 between ends 120 and middle portion 110. Throughout this description, the term "flat," referring to middle portion 110 of roller 100, means having the form of a right substantially circular cylinder of substantially uniform diameter. That diameter may be about the same as in conventional bicycle roller trainers. The length of middle portion 110 (i.e., the distance between the two transitional portions 130) should be greater than the tread width of the bicycle tire, and preferably between about 5 times and about 20 times the tread width of the bicycle tire. Transitional portions 130 increase in diameter from the diameter of middle portion 110 to the diameter of outer portion 120 at a gradual rate, curved or linear. The preferred cross-sectional shape is curvilinear and the preferred rate of change is a parabolic rate, i.e., the diameter increases as a parabolic function of distance along a direction parallel to the roller axis. Thus, the surface of transitional portions 130 is preferably a paraboloid of revolution. The surface of transitional portion 130 is preferably tangent to the surface of middle portion 110 where the two portions meet, to provide a smooth transition with no "corner." Thus, FIG. 12 illustrates this geometric relationship on conventional X-Y coordinate axes: the profile shape of a cross section through portions 110, 120, and 130 is plotted in FIG. 12, where the profile curve of 130 is parabolic, illustrating the preferred tangent relationship at the origin. While the other drawings show a line where portions 110 and 130 join for clarity in describing the various portions, no such line would actually be visible with the preferred tangent relationship.

Optionally, the surface of transitional portions 130 may be coated or formed with a smooth texture to reduce lateral friction to further increase the difficulty of riding up the side of the transitional portions 130.

Axial mounting shaft or axle 140 is inserted longitudinally through roller 100. Roller 100 may be conveniently formed by molding of an elastomer material, such as rubber, or by molding a plastic material such as glass-fiber reinforced plastic. Alternatively roller 100 may be cast, spun, or machined from a metal such as aluminum or steel, or machined from wood, etc.

Figure 3:
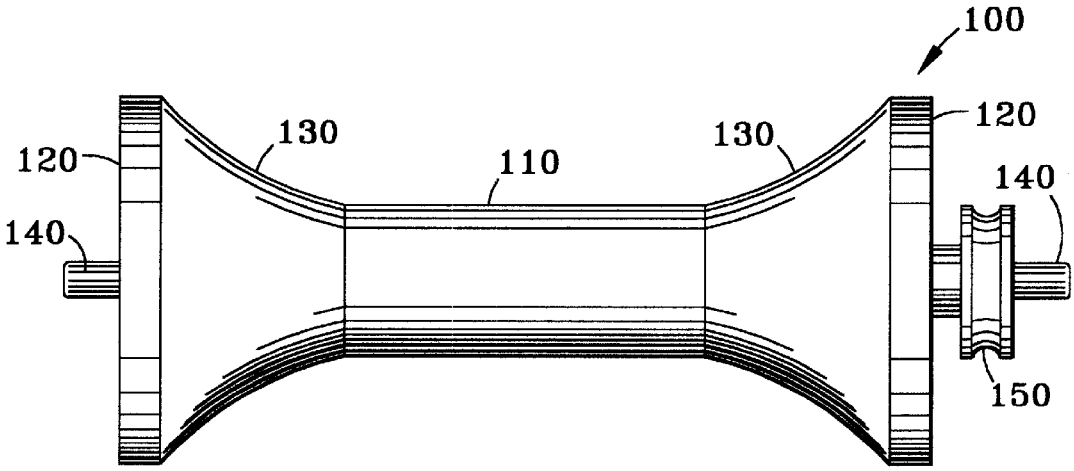
FIG. 3 is a front elevation view of a roller of the bicycle trainer of the present invention having a pulley affixed thereto.
Figure 4:
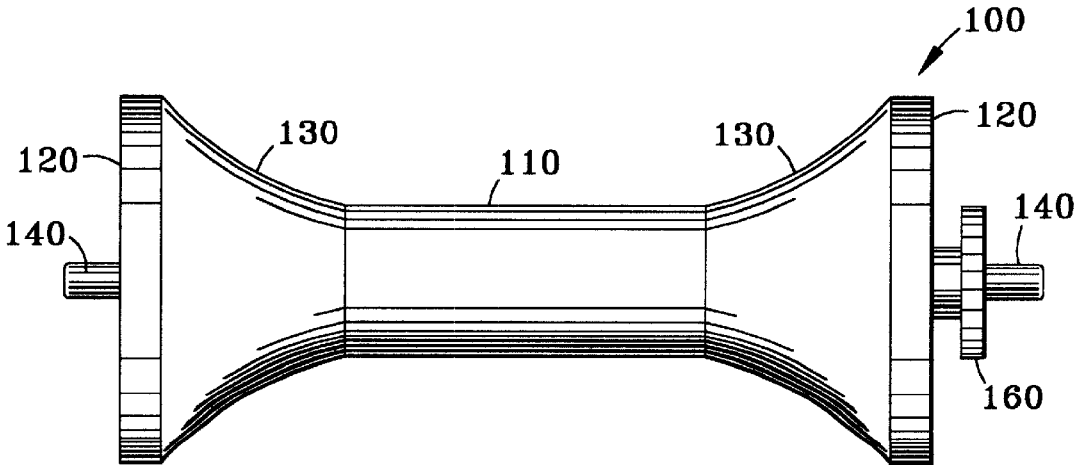
FIG. 4 is a front elevation view of a roller of the bicycle trainer of the present invention having a toothed gear affixed thereto.

FIGS. 3 and 4 are front views of a roller of the bicycle trainer of the present invention having a pulley 150 or a toothed gear 160, respectively, affixed thereto. Pulley 150 or toothed gear 160 is affixed to shaft 140. Either the pulley or gear allows coupling of several rollers together to ensure that they turn at the same rotational rate.

Figure 5:
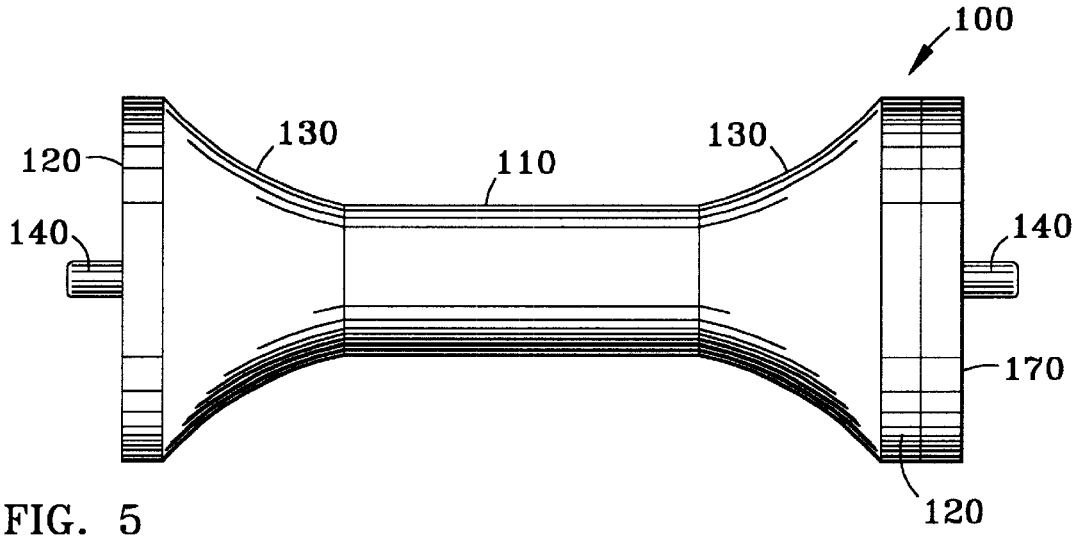
FIG. 5 is a front elevation view of a roller of the bicycle trainer of the present invention having a disk-shaped weight affixed thereto.

FIG. 5 is a front view of a roller of the bicycle trainer of the present invention having a disk-shaped weight affixed thereto. Disk-shaped weight 170 is affixed to one end 120 of roller 100. Disk-shaped weight 170 acts as a flywheel, imparting angular momentum to roller 100 so that it will continue to spin after the rider on the bicycle stops peddling. While only one disk-shaped weight is shown, a second disk-shaped weight may be affixed on the opposite end, thus increasing the flywheel effect on roller 100.

Figure 6:
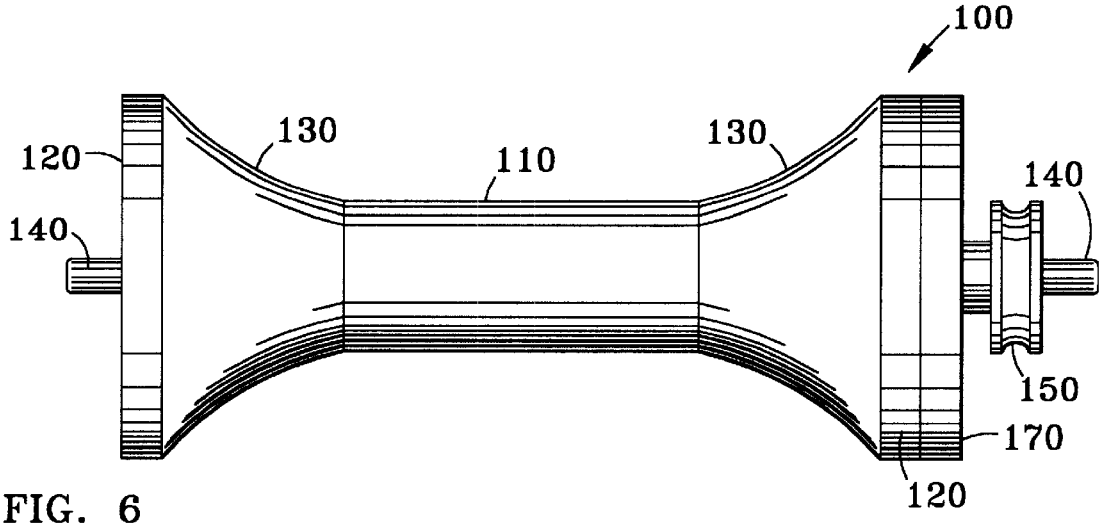
FIG. 6 is a front elevation view of a roller of the bicycle trainer of the present invention having a pulley and a disk-shaped weight affixed thereto.
Figure 7:
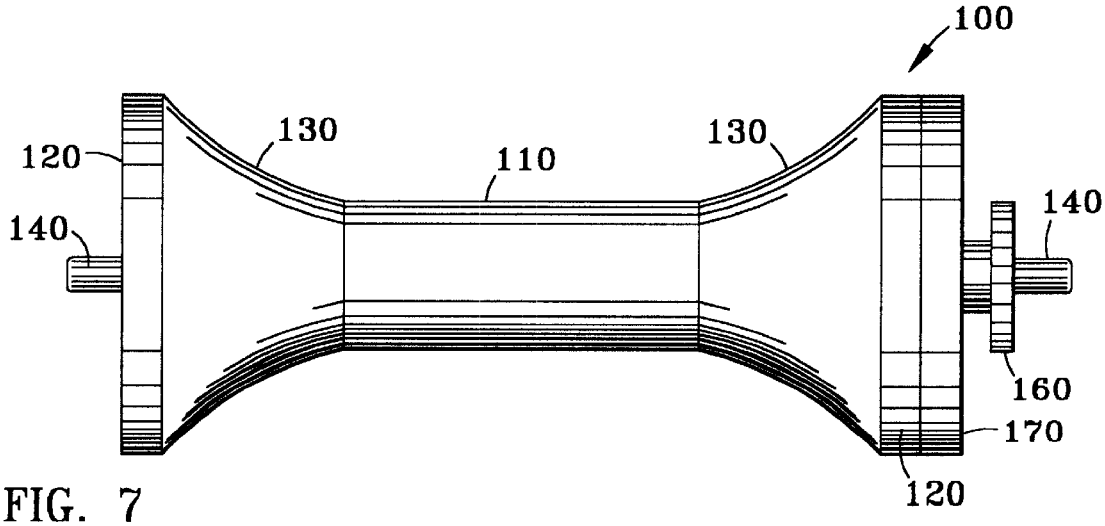
FIG. 7 is a front elevation view of a roller of the bicycle trainer of the present invention having a toothed gear and a disk-shaped weight affixed thereto.

FIGS. 6 and 7 are front views of a roller of the bicycle trainer of the present invention having a pulley or a toothed gear respectively, as well as a disk-shaped weight affixed thereto. Pulley 150 or toothed gear 160 is affixed to shaft 140 and allows coupling of several rollers together to ensure that they turn at the same rotational rate. Additionally disk-shaped weight 170 is affixed to roller 100, preferably at the same end as pulley 150 or toothed gear 160. Optionally, disk-shaped weight 170 may be affixed to the opposite end of roller 100 from that which pulley 150 or toothed gear 160 is affixed. While only one disk-shaped weight is shown, a second disk may be affixed on the opposite end from that of the first, thus increasing the flywheel effect on roller 100.

Figure 8:
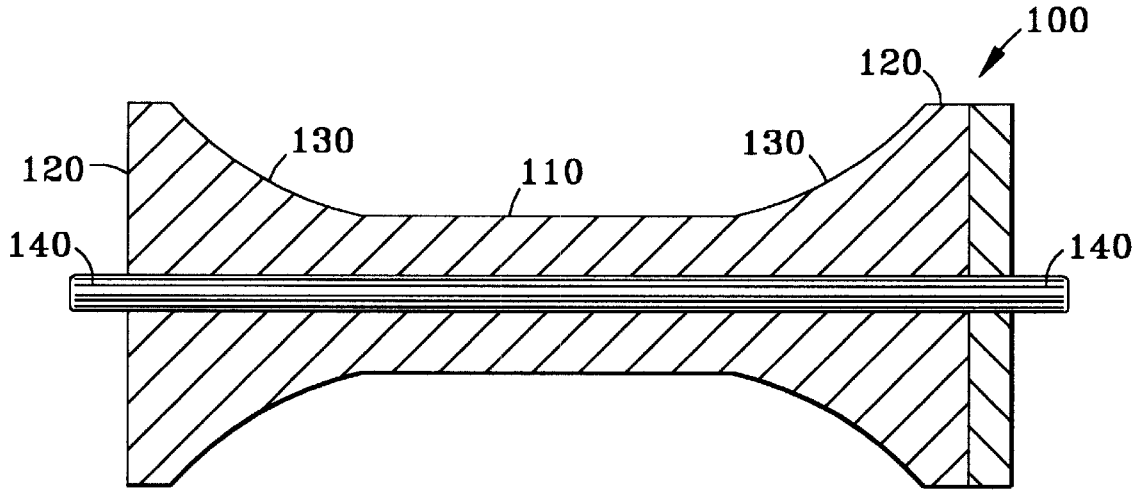
FIG. 8 is a cross-sectional elevation view of a roller of the bicycle trainer of the present invention having a disk-shaped weight affixed thereto.

FIG. 8 is a cross-sectional view of a roller of the bicycle trainer of the present invention having a disk-shaped weight affixed thereto. Disk-shaped weight 170 is affixed to one end 120 of roller 100. Disk-shaped weight 170 is of uniform composition and may be formed from any relatively dense material such as steel or lead. While shown as having the same diameter as end 120, disk-shaped weight 170 may have a diameter greater or less than the diameter of end 120. Those skilled in the mechanical arts will recognize that angular momentum may be increased by forming disk-shaped weight 170 with a rim relatively thickened compared with its central portion, to distribute more of its weight toward its rim, to make a peripherally weighted disk having a higher moment of inertia than a disk of uniform thickness.

Figure 9:
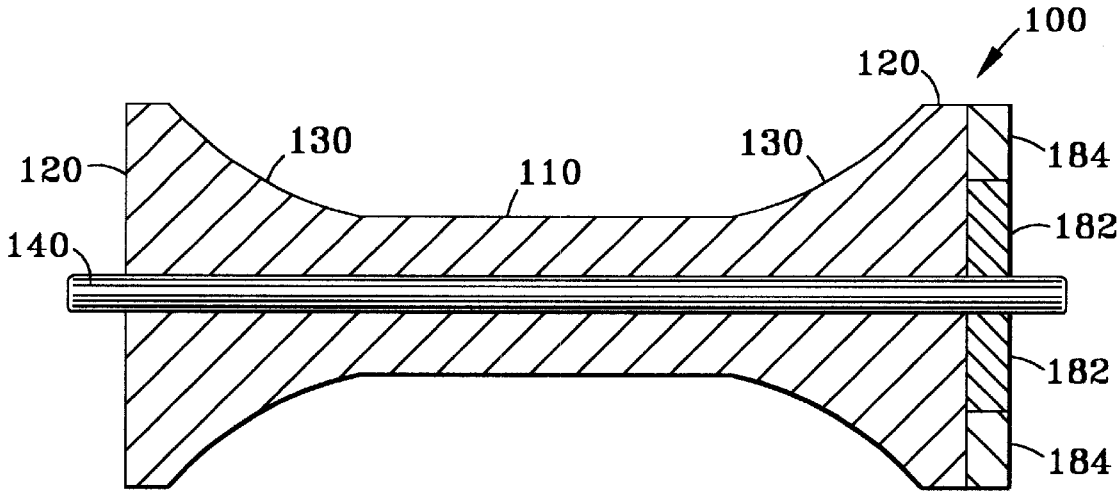
FIG. 9 is a cross-sectional elevation view of a roller of the bicycle trainer of the present invention having a peripherally weighted disk affixed thereto.

FIG. 9 is a cross-sectional view of a roller of the bicycle trainer of the present invention having a peripherally weighted disk affixed thereto. Peripherally weighted disk 180 differs from disk-shaped weight 170 in that it is not of uniform composition but has the denser material located along the circumference of the disk. Disk 180 comprises a central section 182 formed of a light material such as aluminum, or plastic and a denser outer ring 184 formed of a dense material such as steel or lead. Alternatively peripherally weighted disk 180 may be fabricated from a single dense material with the central section thinner than the peripheral section, as described above.

Figure 10:
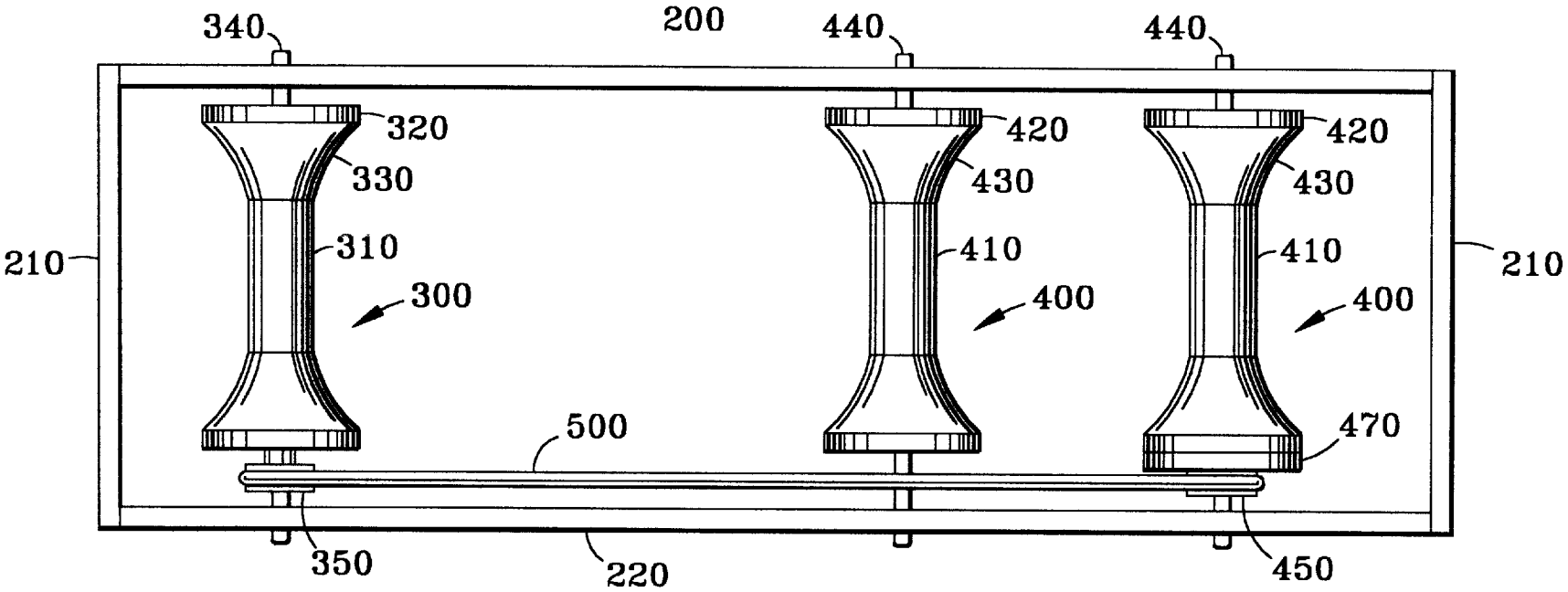
FIG. 10 is a top plan view of the bicycle trainer of the present invention.

FIG. 10 is a top view of the bicycle trainer of the present invention. Bicycle trainer 200 comprises a frame having two sides 220 and two ends 210, holding and supporting front roller 300 and rear rollers 400 rotatably in place at relative positions as shown. Axles 340 and 440 of the rollers are rotatably mounted to the sides 220 of the frame. Roller 300 is constructed similarly to roller 100 described above, having a flat middle portion, two parabolic transitional portions, and two end portions. Rollers 400 are also constructed similarly to roller 100 above, each having a flat middle portion, two parabolic transitional portions, and two end portions. Affixed to one of rear rollers 400 is disk-shaped weight 470. Disk-shaped weight 470 may be of the uniform-composition and uniform-thickness type 170 described above or the peripherally weighted type 180 also described above. Although only one disk-shaped weight 470 is shown, up to six disk-shaped weights may be used, one at each end of each roller, or any combination or sub-combination thereof. Also affixed to one end of roller 300 is pulley 350 and affixed to one end of one of rollers 400 is pulley 450. Either of the rear rollers 400 may be fitted with pulley 450. Pulley belt 500, a conventional pulley belt, is stretched over pulleys 350 and 450 such that any rotational movement of the roller 400 to which pulley 450 is affixed is translated to rotational movement of roller 350. Pulleys 350 and 450 should be of the same diameter. It should be appreciated that the combination of pulleys 350 and 450 and belt 500 could be replaced by a combination of toothed gears and a chain adapted to engage the toothed gears, or by a crown-gear/shaft arrangement, or by any mechanism that links the front roller with at least one rear roller so that the rollers have the same rotational speed. It should be mentioned, however, that in general, the constraint of equal rotational speeds of the front and rear rollers or of the front and rear bicycle wheels is not required for operation of the invention. If used, the arrangements providing equal rotational speeds provide approximately equal angular momentum to front and rear wheels and thus approximately equal gyroscopic balancing action, avoiding unrealistic torques.

Figure 11:
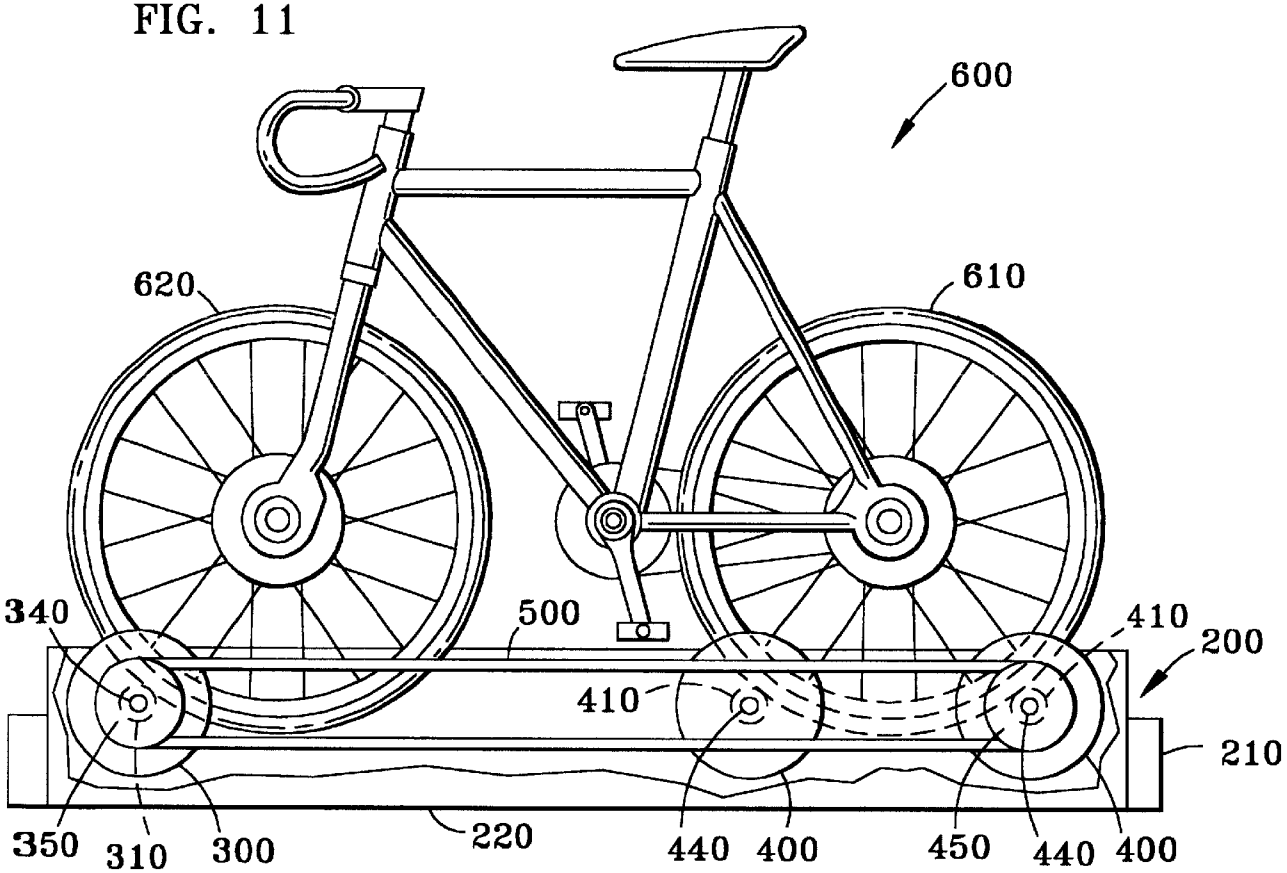
FIG. 11 is a cutaway side elevation view of the bicycle trainer of the present invention.

FIG. 11 shows a cutaway schematic side view of a bicycle trainer made in accordance with the present invention. Bicycle 600 is shown free standing in bicycle trainer 200 for illustrative purposes; bicycle 600 itself is not part of the invention. Rear wheel tire 610 of bicycle 600 engages both of rollers 400 and is supported by them. The lowest point of rear wheel tire 610 is lower than the tops of rollers 400. Front wheel tire 620 of bicycle 600 may engage front roller 300 at a position on wheel tire 620 forward of the center of wheel tire 620, as shown in FIG. 11. Such an arrangement allows the lowest point on each tire to be at approximately the same level, giving the user a feeling of riding on a level surface. Alternatively, front wheel tire 620 of bicycle 600 may engage front roller 300 at a position on wheel tire 620 approximately under the center of wheel tire 620. In that case, if a very level riding feel is desired, the axis of front roller 300 may be disposed lower than the axis of rear rollers 400. Although no adjustment mechanisms are illustrated in the drawings, it will be recognized that a bicycle trainer made in accordance with the present invention may have conventional means for adjusting the distances between rollers to accommodate bicycles of various sizes, and may have a conventional leveling adjustment for leveling the frame. A step or steps (not shown) may be provided at one or both sides of the frame for convenience in mounting the bicycle.

In normal operation of the apparatus, the user would pedal the bicycle with the bicycle wheel tires 610 and 620 positioned on the flat middle portions of rollers 300 and 400. If either or both of the bicycle wheel tires 610 and 620 move laterally towards any of the ends 310 and 410 of rollers 300 and 400 they will ride up on transitional portions 330 and 430 of rollers 300 and 400 respectively. This imparts an increasing lateral force to the wheels back toward the middle portion of the rollers the closer the wheel tires come to the ends of the rollers. Thus, a natural "feel" is combined with improved safety, allowing the user to focus and concentrate on training in specific areas of cycling fitness and technique.

The periphery of each of the rollers may be padded with a conventional soft, resilient padding material at its maximum diameter for improved safety. Such padding is not shown in the drawings.

Figure 13:
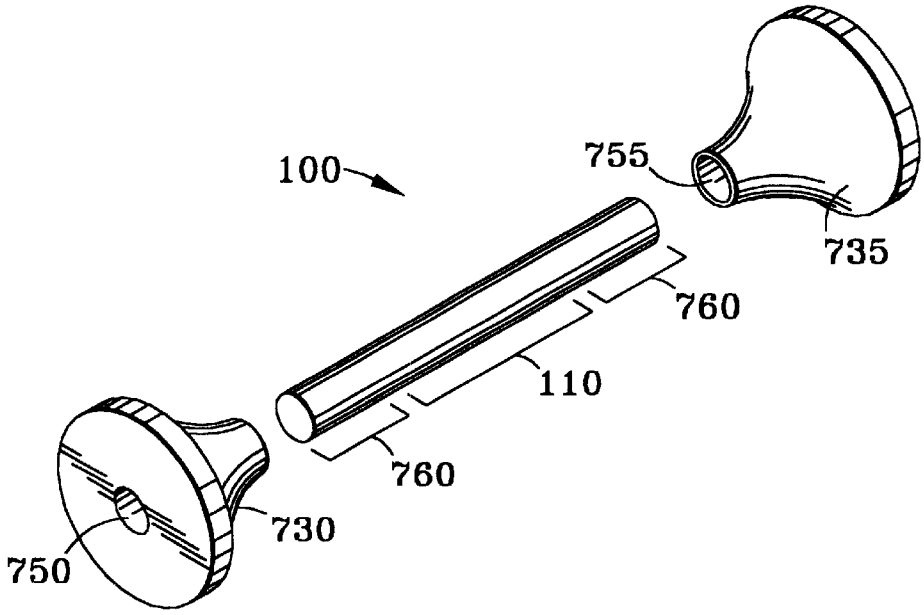
FIG. 13 is an exploded perspective view of a preferred embodiment of a roller of the bicycle trainer.
Figure 14:
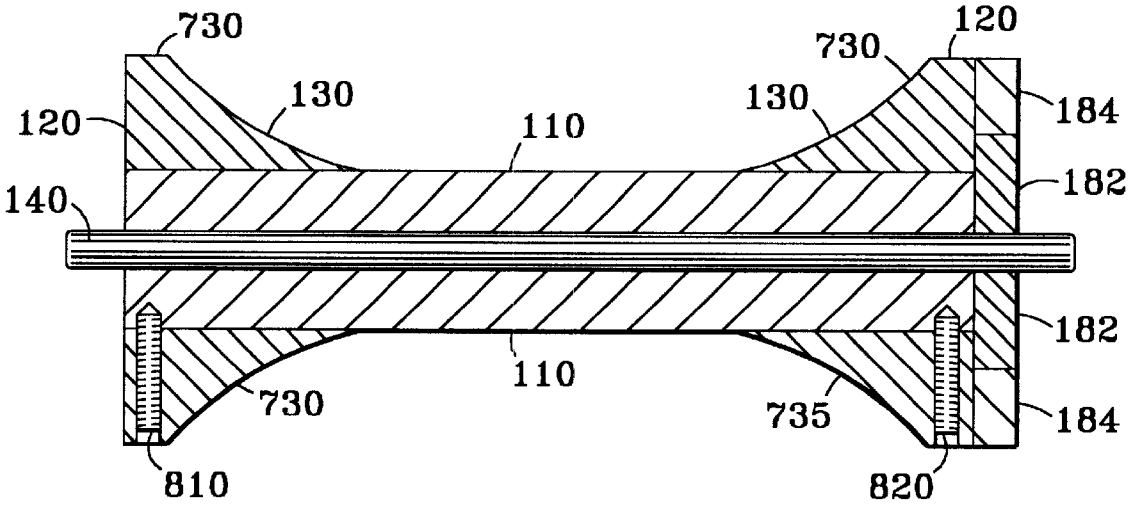
FIG. 14 is a cross-sectional elevation view of the roller of FIG. 13 as assembled.

A preferred method of making roller 100 uses a base roller similar to a conventional right cylindrical roller long enough to allow fitting, over each end, a separate end piece 730 or 735, each including an end portion 120 and having the curved contour of transitional portion 130. FIGS. 13 and 14 illustrate the construction of this preferred embodiment. FIG. 14 is similar to FIG. 9, except for the construction of roller 100.

As shown in FIGS. 13 and 14, the base roller has the form of a right circular cylinder with 'flat' middle portion 110 and base-roller end portions 760. End pieces 730 and 735 have openings 750 and 755 respectively for fitting over base roller end portions 760. End pieces 730 and 735 are affixed to base-roller end portions 760. End pieces 730 and 735 may make a press fit over base-roller end portions 760, fitting tightly enough to prevent rotation of end pieces 730 and 735 relative to the base roller. Preferably, however, end pieces 730 and 735 are affixed to base-roller end portions 760 with suitable fasteners 810 and 820. While FIG. 14 shows fasteners 810 and 820 as setscrews, other suitable fasteners may be substituted. Also, fasteners 810 and 820 need not be aligned with each other in a common plane and on one side as shown in FIG. 14, but are preferably disposed in opposed relationship for improved balance of completed roller 100. As shown in. FIG. 14, the roller may have a peripherally weighted disk with a lower density central section 182 and a denser outer ring 184, as described above with reference to FIG. 9.

INDUSTRIAL APPLICABILITY

The invention is useful in the manufacture of bicycle training apparatus that permits a user to train in an indoor environment while maintaining a natural and realistic feel with improved safety.

The description of the embodiments of the present invention is given above for the understanding of the present invention. It will be understood that the invention is not limited to the particular embodiments described herein, but is capable of various modifications, rearrangements, and substitutions which will now become apparent to those skilled in the art without departing from the scope of the invention. For example, although trainer 200 has been illustrated with rollers 300 and 400 of the same size and width, the invention is capable of utilizing combinations of rollers of various lengths and widths, having various middle and end diameters and various rates of diameter increase in the transitional portions of the rollers.

Therefore it is intended that the following claims cover all such modifications and changes as fall within the true spirit and scope of the invention.

What is claimed is:

1. A training apparatus comprising a middle portion, first and second ends, first and second transitional portions between said middle portion and said first and second ends, said middle portion having a first substantially uniform diameter, said middle portion further having a length sufficiently greater than tread width of a tire of a bicycle with which the apparatus is used to allow for sufficient lateral movement of said bicycle tire on said middle portion for skill training, wherein said first and second ends each have a diameter larger than said first diameter, wherein said transitional portions increase in diameter from said substantially uniform middle portion to said first and second ends to limit said lateral movement, wherein the location of at least one transitional portion along said middle portion is variable.

2. The training apparatus according to claim 1, wherein diameter of said transitional portions increases first diameter to said second diameter along a curvilinear profile.

3. The bicycle training apparatus according to claim 1, comprising first, second, and third rollers, each of said rollers as recited in claim 1, said first roller being disposed to support the front wheel tire of said bicycle, and said second and third rollers being disposed to support the rear wheel tire of said bicycle to allow for sufficient lateral movement of said bicycle on said rollers for skill training while constraining said bicycle from falling off said rollers.

4. A bicycle training apparatus according to claim 3, wherein each of said transitional portions of each of said first, second, and third rollers comprises a separate piece affixed to said middle portion, said transitional portions being spaced apart by a distance for delimiting said middle portion of said roller.

5. A training apparatus according to claim 1, wherein said first and second transitional portions each comprise a separate piece affixed to said middle portion, said first and second transitional portions being spaced apart by a distance for delimiting said middle portion of said roller.

6. A training apparatus according to claim 5, wherein said separate piece of each of said transitional portions has an opening for fitting over said middle portion.

7. A training apparatus according to claim 5, wherein said first transitional portion further comprises a fastener for affixing said first transitional portion to said middle portion of said roller.

8. A training apparatus according to claim 1, wherein said first and second transitional portions are separated by a distance between about 5 times and about 20 times tread width of a bicycle tire.

9. A training apparatus according to claim 1, wherein said first and second transitional portions each comprise a separate piece affixed said middle portion, said first and second transitional portions being spaced apart by a distance for delimiting said middle portion of said roller and defining said length of said middle portion.

10. A bicycle training apparatus, comprising:

a frame and a roller supported by said frame, said roller comprising: a middle portion of a first diameter, said middle portion further having a length greater than tread width of a tire of a bicycle with which the training apparatus is used to allow for large lateral movement of the bicycle on said middle portion for skill training;

first and second ends, each of a second diameter, said second diameter being larger than said first diameter;

first and second trasitiorial portions increasing in diameter from said first diameter to said second diameter, wherein said first and second transitional portions are between said middle portion and said first and second ends.

11. The training apparatus according to claim 10, wherein the diameter of said first and second transitional portions increases along a curvilinear profile.

12. The training apparatus according to claim 11, wherein the diameter of said first and second transitional portions increases at a parabolic rate.

13. The training apparatus according to claim 10, further comprising a generally disk-shaped weight disposed at least one end of said roller.

14. The training apparatus according to claim 13, wherein said generally disk-shaped weight has substantially uniform thickness and composition.

15. The training apparatus according to claim 13, wherein said generally disk-shaped weight is peripherally weighted to increase its moment of inertia.

16. The training apparatus according to claim 10, further comprising means for linking said roller to connecting means.

17. The training apparatus according to claim 1, further comprising means for linking said roller to connecting means.

18. The training apparatus according to claim 17, wherein said means for linking comprises a pulley.

19. The training apparatus according to claim 17, wherein said means for linking comprises a toothed gear.

20. The training apparatus according to claim 1, wherein said roller comprises a material selected from the list consisting of an elastomer, a plastic, a glass-fiber reinforced material, wood, and a metal.

21. A training apparatus comprising a substantially cylindrical portion, a first transitional portion, and a second first transitional portion, wherein said substantially cylindrical portion, said first transitional portion and said second transitional portion each comprise a separate piece, wherein location of said first and second transitional portions along said substantially cylindrical portion is adjustable.

22. A training apparatus as recited in claim 21, wherein said first transitional portion and said second transitional portion are spaced apart by a distance sufficient to allow for sufficient lateral movement of a bicycle on said substantially cylindrical portion for skill training while constraining the bicycle from falling off the roller.

23. A training apparatus as recited in claim 21, wherein said first transitional portion and said second transitional portion each comprise an opening for fitting over said substantially cylindrical portion.

24. A training apparatus as recited in claim 21, wherein said first transitional portion and said second transitional portion each further comprise a fastener for affixing to said substantially cylindrical portion.

25. A training apparatus as recited in claim 21, wherein diameter of said first transitional portion and said second transitional portion increases along a curvilinear profile.

26. A training apparatus as recited in claim 21, wherein the diameter of said first transitional portion and said second transitional portion increases at a parabolic rate.

27. A training apparatus as recited in claim 21, further comprising a generally disk-shaped weight disposed at least one end of said roller.

28. A training apparatus as recited in claim 27, wherein said generally disk-shaped weight has substantially uniform thickness and composition.

29. A training apparatus as recited in claim 27, wherein said generally disk-shaped weight is peripherally weighted to increase its moment of inertia.

30. A training apparatus as recited in claim 21, further comprising means for linking said roller to connecting means.

31. A training apparatus as recited in claim 30, wherein said means for linking comprises a pulley.

32. A training apparatus as recited in claim 30, wherein said means for linking comprises a toothed gear.

33. A training apparatus as recited in claim 21, wherein said roller comprises a material selected from the list consisting of an elastomer, a plastic, a glass-fiber reinforced material, wood, and a metal.

* * * * *